US010775726B2

(12) United States Patent
Furuichi

(10) Patent No.: US 10,775,726 B2
(45) Date of Patent: Sep. 15, 2020

(54) IMAGE FORMING APPARATUS WITH A HEATING DEVICE HAVING A FEEDING MEMBER ON A NON-DRIVING SIDE OF A DRIVING ROLLER

(71) Applicant: Yuusuke Furuichi, Kanagawa (JP)

(72) Inventor: Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/550,348

(22) Filed: Aug. 26, 2019

(65) Prior Publication Data

US 2020/0117125 A1 Apr. 16, 2020

(30) Foreign Application Priority Data

Oct. 10, 2018 (JP) ..... 2018-191718

(51) Int. Cl.
*G03G 15/20* (2006.01)
*G03G 21/20* (2006.01)

(52) U.S. Cl.
CPC ..... *G03G 15/2046* (2013.01); *G03G 15/2053* (2013.01); *G03G 21/206* (2013.01)

(58) Field of Classification Search
CPC ..... G03G 15/2053; G03G 15/2046; G03G 15/2017; G03G 21/206; G03G 21/1652
See application file for complete search history.

(56) References Cited

U.S. PATENT DOCUMENTS 5,866,875 A * 2/1999 Okabayashi ..... G03G 15/206 219/216
6,254,979 B1 * 7/2001 Drew ..... B32B 15/01 205/109
10,303,095 B2 * 5/2019 Takagi ..... G03G 15/2039
2017/0363995 A1 * 12/2017 Takagi ..... G03G 15/2007
2019/0041782 A1 * 2/2019 Nishikawa ..... G03G 15/2028

FOREIGN PATENT DOCUMENTS

JP 2000-268940 9/2000
WO WO2015/012306 A1 1/2015

OTHER PUBLICATIONS

Machine translation of WO 2015/012306 (Year: 2015).*

(Continued)

*Primary Examiner* — Arlene Heredia
(74) *Attorney, Agent, or Firm* — Oblon, McClelland, Maier & Neustadt, L.L.P.

(57) ABSTRACT

A heating device includes a heater including a heat generator that generates heat as the heat generator is supplied with power. A feeding member contacts the heater and feeds the power to the heat generator. An endless belt rotates and is heated by the heater. A driving roller contacts an outer circumferential surface of the endless belt. A driving force transmitter is disposed at one lateral end of the driving roller in an axial direction of the driving roller. The driving force transmitter transmits a driving force that drives and rotates the driving roller. The feeding member is made of a corson copper alloy and is disposed in a non-driving side defined by a center of the heat generator in a longitudinal direction of the heater. The non-driving side is opposite a driving side in the longitudinal direction of the heater, where the driving force transmitter is disposed.

20 Claims, 12 Drawing Sheets

(56) References Cited

OTHER PUBLICATIONS

Palladium-Silver alloy data,http://www.matweb.com/search/datasheet_print.aspx?matguid=44ce9a1b61594e02a58f3d99b190bca6; Retrieved: Jan. 31, 2020 (Year: 2020).*
U.S. Appl. No. 16/263,634, filed Jan. 31, 2019, Yuusuke Furuichi, et al.
U.S. Appl. No. 16/269,616, filed Feb. 7, 2019, Tomoya Adachi, et al.
U.S. Appl. No. 16/285,733, filed Feb. 26, 2019, Yuusuke Furuichi, et al.
U.S. Appl. No. 16/352,390, filed Mar. 13, 2019, Tomoya Adachi, et al.
U.S. Appl. No. 16/391,959, filed Apr. 23, 2019, Takamasa Hase, et al.
U.S. Appl. No. 16/520,409, filed Jul. 24, 2019, Hiroshi Yoshinaga, et al.
U.S. Appl. No. 16/502,473, filed Jul. 3, 2019, Yuusuke Furuichi, et al.
U.S. Appl. No. 16/519,254, filed Jul. 23, 2019, Daisuke Inoue, et al.
U.S. Appl. No. 16/451,512, filed Jun. 25, 2019, Tomoya Adachi, et al.
U.S. Appl. No. 16/502,348, filed Jul. 3, 2019, Yuusuke Furuichi, et al.

* cited by examiner

IMAGE FORMING APPARATUS WITH A HEATING DEVICE HAVING A FEEDING MEMBER ON A NON-DRIVING SIDE OF A DRIVING ROLLER

CROSS-REFERENCE TO RELATED APPLICATION

This patent application is based on and claims priority pursuant to 35 U.S.C. § 119(a) to Japanese Patent Application No. 2018-191718, filed on Oct. 10, 2018, in the Japan Patent Office, the entire disclosure of which is hereby incorporated by reference herein.

BACKGROUND

Technical Field

Exemplary aspects of the present disclosure relate to a heating device, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes a toner image on a sheet serving as a recording medium under heat or a dryer that dries ink on a sheet. The fixing device and the dryer employ a laminated heater incorporating a laminated, resistive heat generator as a heater installed in the fixing device and the dryer.

The laminated heater is coupled to a feeding member that supplies power to the resistive heat generator. The feeding member is a resilient member such as a flat spring. As the feeding member resiliently contacts an electrode disposed in the laminated heater, conduction is established at a contact between the feeding member and the electrode, supplying power from a power supply to the resistive heat generator.

However, since the feeding member is under high temperatures, if the feeding member suffers from temperature increase and resultant creep deformation, the feeding member may not attain a desired resilience. In this case, contact pressure with which the feeding member contacts the electrode of the laminated heater decreases, causing faulty contact and faulty conduction.

The feeding member may suffer from temperature increase due to heat generation of the feeding member as the feeding member is supplied with power, other than conduction of heat from the laminated heater as described above. Hence, in order to suppress temperature increase of the feeding member further, the feeding member is requested to decrease heat generation while the feeding member is supplied with power, in addition to conduction of heat from the laminated heater. Additionally, the feeding member is requested to be less susceptible to heat from a heat generating source other than the laminated heater.

SUMMARY

This specification describes below an improved heating device. In one embodiment, the heating device includes a heater including a heat generator configured to generate heat as the heat generator is supplied with power. A feeding member is configured to contact the heater and feed the power to the heat generator. An endless belt is configured to rotate and to be heated by the heater. A driving roller is configured to contact an outer circumferential surface of the endless belt. A driving force transmitter is disposed at one lateral end of the driving roller in an axial direction of the driving roller. The driving force transmitter is configured to transmit a driving force that drives and rotates the driving roller. The feeding member is made of a corson copper alloy and is disposed in a non-driving side defined by a center of the heat generator in a longitudinal direction of the heater. The non-driving side is opposite a driving side in the longitudinal direction of the heater, where the driving force transmitter is disposed.

This specification further describes an improved fixing device. In one embodiment, the fixing device includes an endless belt configured to rotate and an opposed rotator configured to contact the endless belt. A heater is configured to heat the endless belt. The heater includes a heat generator configured to generate heat as the heat generator is supplied with power. A feeding member is configured to contact the heater and feed the power to the heat generator. A driving force transmitter is disposed at one lateral end of the opposed rotator in an axial direction of the opposed rotator. The driving force transmitter is configured to transmit a driving force that drives and rotates the opposed rotator. The feeding member is made of a corson copper alloy and is disposed in a non-driving side defined by a center of the heat generator in a longitudinal direction of the heater. The non-driving side is opposite a driving side in the longitudinal direction of the heater, where the driving force transmitter is disposed.

This specification further describes an improved image forming apparatus. In one embodiment, the image forming apparatus includes an image forming device configured to form an image and a heating device configured to heat the image borne on a recording medium. The heating device includes a heater including a heat generator configured to generate heat as the heat generator is supplied with power. A feeding member is configured to contact the heater and feed the power to the heat generator. An endless belt is configured to rotate and to be heated by the heater. A driving roller is configured to contact an outer circumferential surface of the endless belt. A driving force transmitter is disposed at one lateral end of the driving roller in an axial direction of the driving roller. The driving force transmitter is configured to transmit a driving force that drives and rotates the driving roller. The feeding member is made of a corson copper alloy and is disposed in a non-driving side defined by a center of the heat generator in a longitudinal direction of the heater. The non-driving side is opposite a driving side in the longitudinal direction of the heater, where the driving force transmitter is disposed.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
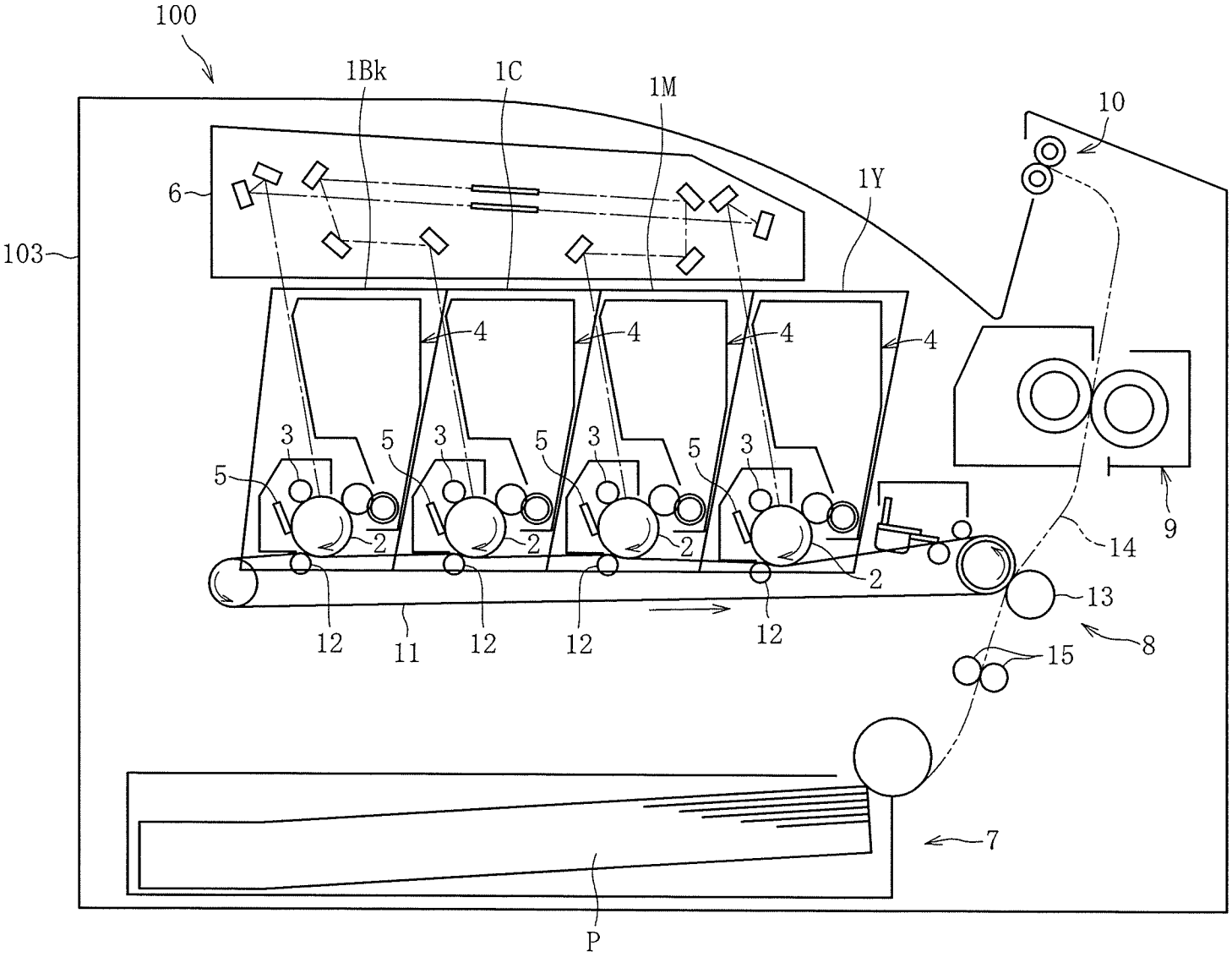
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes a construction of an image forming apparatus 100 according to embodiments of the present disclosure. In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of the image forming apparatus 100 according to an embodiment of the present disclosure. The image forming apparatus 100 is a printer. Alternatively, the image forming apparatus 100 may be a copier, a facsimile machine, a multifunction peripheral (MFP) having at least two of printing, copying, facsimile, scanning, and plotter functions, or the like.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium or a conveyed medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon.

Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the timing roller pair 15 conveys the sheet P to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
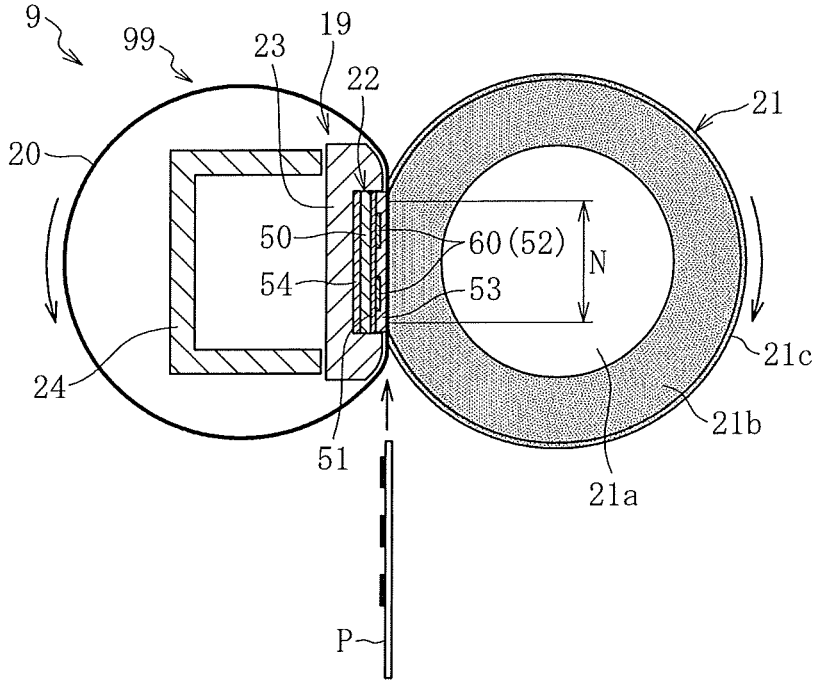
FIG. 2 is a schematic cross-sectional view of a fixing device incorporated in the image forming apparatus depicted in FIG. 1.

As illustrated in FIG. 2, the fixing device 9 according to this embodiment includes a fixing belt 20, a pressure roller 21, and a heating device 19. The fixing belt 20 is an endless belt serving as a fixing rotator or a fixing member. The pressure roller 21 serves as an opposed rotator or an opposed member that contacts an outer circumferential surface of the fixing belt 20 to form a nip, that is, a fixing nip N, between the fixing belt 20 and the pressure roller 21. The heating device 19 heats the fixing belt 20. The heating device 19 includes a heater 22, a heater holder 23, and a stay 24. The heater 22 is a laminated heater and serves as a heater or a heating member. The heater holder 23 serves as a holder that holds or supports the heater 22. The stay 24 serves as a reinforcement that reinforces the heater holder 23 throughout an entire width of the heater holder 23 in a longitudinal direction thereof. Alternatively, the fixing device 9 may be a heating device 99 that includes a driving roller (e.g., the pressure roller 21).

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface (e.g., an outer periphery) of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A detailed description is now given of a construction of the heater 22.

The heater 22 extends in a longitudinal direction thereof throughout an entire width of the fixing belt 20 in a width direction, that is, an axial direction, of the fixing belt 20. The heater 22 contacts the inner circumferential surface of the fixing belt 20. The heater 22 may not contact the fixing belt 20 or may be disposed opposite the fixing belt 20 indirectly via a low friction sheet or the like. However, the heater 22 that contacts the fixing belt 20 directly enhances conduction of heat from the heater 22 to the fixing belt 20. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, the heater 22 contacts the inner circumferential surface of the fixing belt 20 advantageously.

The heater 22 includes a base layer 50, a first insulating layer 51, a conductor layer 52, a second insulating layer 53, and a third insulating layer 54. The first insulating layer 51, the conductor layer 52, and the second insulating layer 53 are layered on the base layer 50 in this order and sandwiched between the base layer 50 and the fixing nip N. The conductor layer 52 includes a heat generator 60. The third insulating layer 54 is layered on the base layer 50 and is disposed opposite the fixing nip N via the base layer 50.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side walls (e.g., side plates) of the fixing device 9, respectively. The stay 24 supports a stay side face of the heater holder 23, that faces the stay 24 and is opposite a heater side face of the heater holder 23, that faces the heater 22. Accordingly, the stay 24 retains the heater 22 and the heater holder 23 to be immune from being bent substantially by pressure from the pressure roller 21, forming the fixing nip N between the fixing belt 20 and the pressure roller 21. According to this embodiment, the heater 22 and the pressure roller 21 sandwich the fixing belt 20. Thus, the heater 22 disposed opposite the inner circumferential surface of the fixing belt 20 serves as a nip former (e.g., a nip forming pad) that forms the fixing nip N between the fixing belt 20 and the pressure roller 21. Hence, the heater 22 downsizes the fixing device 9 compared to a construction described below with reference to FIG. 18, in which the heater 22 is provided separately from a nip forming pad 91.

Since the heater holder 23 is subject to temperature increase by heat from the heater 22, the heater holder 23 is preferably made of a heat resistant material. For example, if the heater holder 23 is made of heat resistant resin having a decreased thermal conductivity, such as liquid crystal polymer (LCP) and PEEK, the heater holder 23 suppresses conduction of heat thereto from the heater 22, facilitating heating of the fixing belt 20.

A spring serving as a biasing member causes the fixing belt 20 and the pressure roller 21 to press against each other. Thus, the fixing nip N is formed between the fixing belt 20 and the pressure roller 21. As a driving force is transmitted to the pressure roller 21 from a driver disposed inside the body 103 of the image forming apparatus 100, the pressure roller 21 serves as a driving roller that drives and rotates the fixing belt 20. The fixing belt 20 is driven and rotated by the pressure roller 21 as the pressure roller 21 rotates. While the fixing belt 20 rotates, the fixing belt 20 slides over the heater 22. In order to facilitate sliding of the fixing belt 20, a lubricant such as oil and grease may be interposed between the heater 22 and the fixing belt 20.

When printing starts, the driver drives and rotates the pressure roller 21 and the fixing belt 20 starts rotation in accordance with rotation of the pressure roller 21. Additionally, as power is supplied to the heater 22, the heater 22 heats the fixing belt 20. In a state in which the temperature of the fixing belt 20 reaches a predetermined target temperature (e.g., a fixing temperature), as the sheet P bearing the unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

Figure 3:
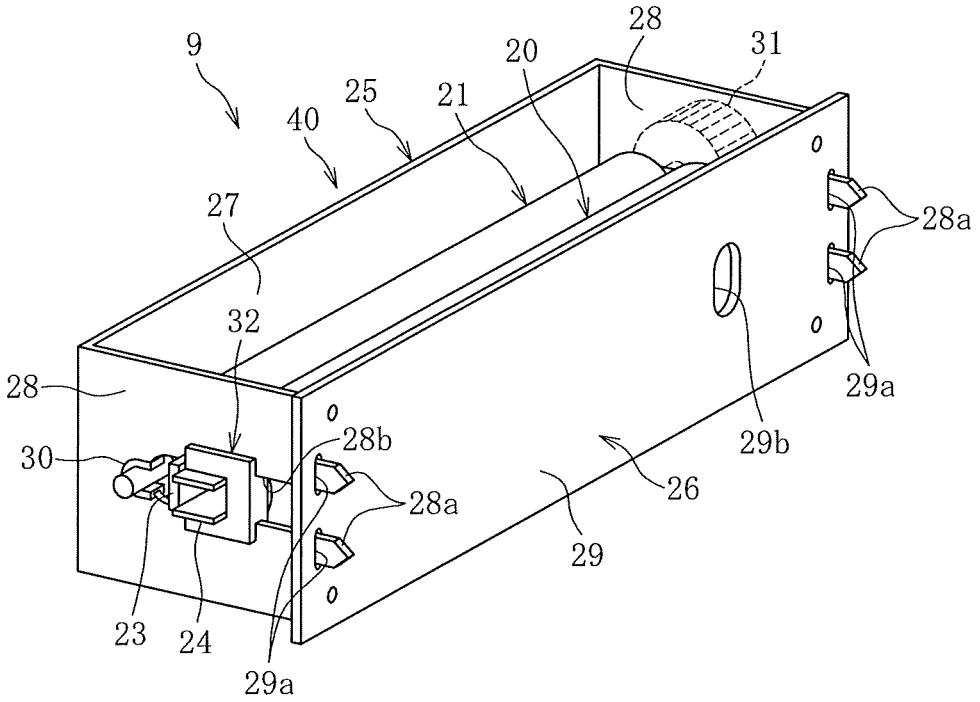
FIG. 3 is a perspective view of the fixing device depicted in FIG. 2.
Figure 4:
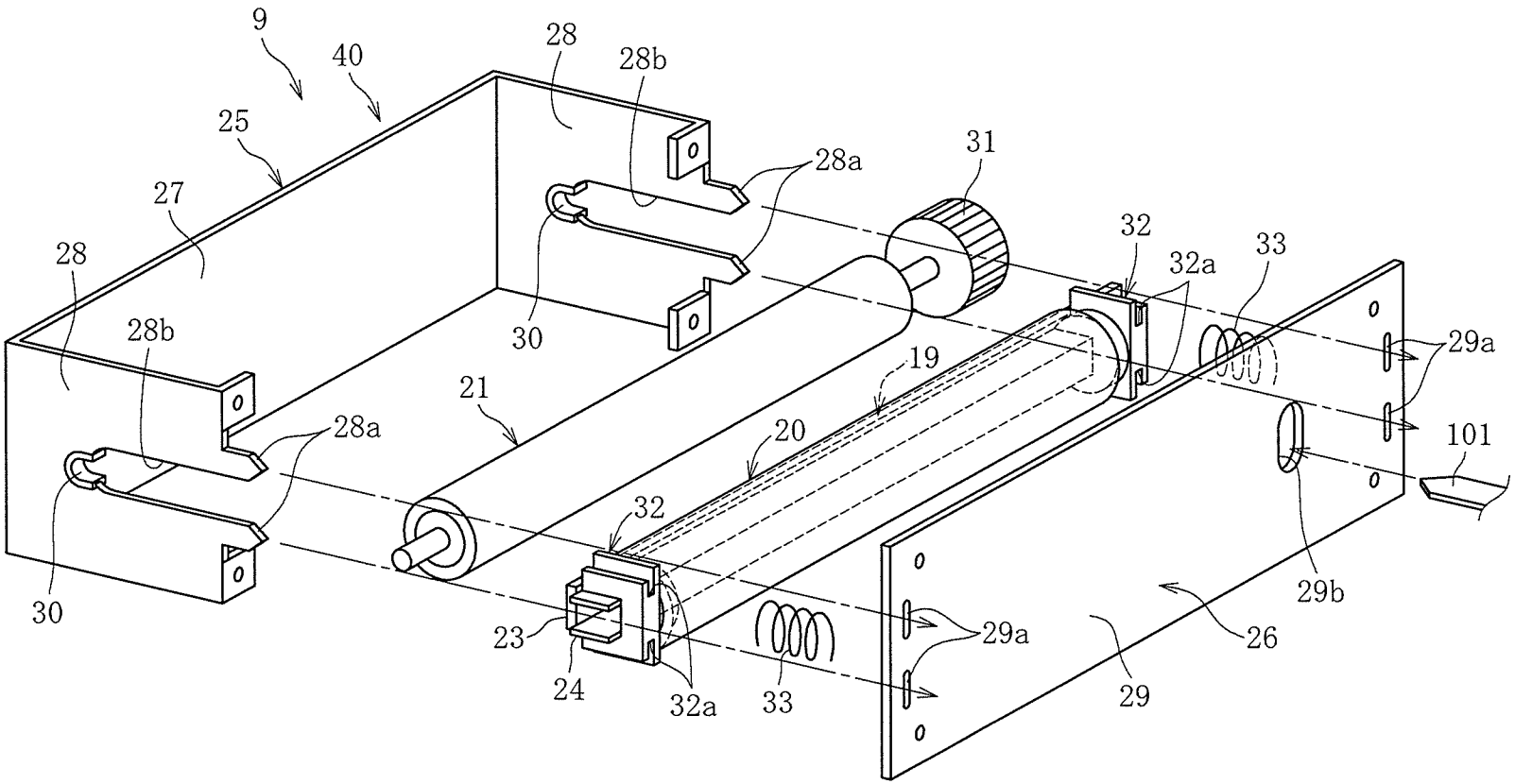
FIG. 4 is an exploded perspective view of the fixing device depicted in FIG. 3.

FIG. 3 is a perspective view of the fixing device 9. FIG. 4 is an exploded perspective view of the fixing device 9.

As illustrated in FIGS. 3 and 4, the fixing device 9 includes a device frame 40 that includes a first device frame 25 and a second device frame 26. The first device frame 25 includes a pair of side walls 28 and a front wall 27. The second device frame 26 includes a rear wall 29. The side walls 28 are disposed at one lateral end and another lateral end of the fixing belt 20, respectively, in the width direction of the fixing belt 20. The side walls 28 support both lateral ends of each of the pressure roller 21 and the heating device 19, respectively. Each of the side walls 28 includes a plurality of engaging projections 28*a*. As the engaging projections 28*a* engage engaging holes 29*a* penetrating through the rear wall 29, respectively, the first device frame 25 is coupled to the second device frame 26.

Each of the side walls 28 includes an insertion recess 28*b* through which a rotation shaft and the like of the pressure roller 21 are inserted. The insertion recess 28*b* is open at an opening that faces the rear wall 29 and closed at a bottom that is opposite the opening and serves as a contact portion. A bearing 30 that supports the rotation shaft of the pressure roller 21 is disposed at an end of the insertion recess 28*b*, that serves as the contact portion. As both lateral ends of the rotation shaft of the pressure roller 21 in an axial direction thereof are attached to the bearings 30, respectively, the side walls 28 rotatably support the pressure roller 21.

A driving force transmission gear 31 serving as a driving force transmitter is disposed at one lateral end of the rotation shaft of the pressure roller 21 in the axial direction thereof. In a state in which the side walls 28 support the pressure roller 21, the driving force transmission gear 31 is exposed outside the side wall 28. Accordingly, when the fixing device 9 is installed in the body 103 of the image forming apparatus 100, the driving force transmission gear 31 is coupled to a gear disposed inside the body 103 of the image forming apparatus 100 so that the driving force transmission gear 31 transmits the driving force from the driver. Alternatively, a driving force transmitter that transmits the driving force to the pressure roller 21 may be pulleys over which a driving force transmission belt is stretched taut, a coupler, and the like instead of the driving force transmission gear 31.

A pair of supports 32 that supports the fixing belt 20 and the like is disposed at both lateral ends of the heating device 19 in a longitudinal direction thereof, respectively. Each of the supports 32 is a device frame of the heating device 19 and a part of the device frame 40 of the fixing device 9. The supports 32 support the fixing belt 20 in a state in which the fixing belt 20 is not basically applied with tension in a circumferential direction thereof while the fixing belt 20 does not rotate, that is, by a free belt system. Each of the supports 32 includes guide grooves 32*a*. As the guide grooves 32*a* move along edges of the insertion recess 28*b* of the side wall 28, respectively, the support 32 is attached to the side wall 28.

A pair of springs 33 serving as a pair of biasing members is interposed between each of the supports 32 and the rear wall 29. As the springs 33 bias the stay 24 and the supports 32 toward the pressure roller 21, respectively, the fixing belt 20 is pressed against the pressure roller 21 to form the fixing nip N between the fixing belt 20 and the pressure roller 21.

As illustrated in FIG. 4, a hole 29*b* is disposed at one lateral end of the rear wall 29 of the second device frame 26 in a longitudinal direction of the second device frame 26.

The hole 29*b* serves as a positioner that positions a body of the fixing device 9 with respect to the body 103 of the image forming apparatus 100. When the body of the fixing device 9 is installed inside the body 103 of the image forming apparatus 100, a projection 101 serving as a positioner disposed inside the body 103 of the image forming apparatus 100 is inserted into the hole 29*b* of the fixing device 9. Accordingly, the projection 101 engages the hole 29*b*, positioning the body of the fixing device 9 with respect to the body 103 of the image forming apparatus 100 in a longitudinal direction of the fixing device 9, that is, the width direction or the axial direction of the fixing belt 20. Although the hole 29*b* serving as a positioner is disposed at one lateral end of the rear wall 29 in the longitudinal direction of the second device frame 26, a positioner is not disposed at another lateral end of the rear wall 29. Thus, the second device frame 26 does not restrict thermal expansion and shrinkage of the body of the fixing device 9 in the longitudinal direction thereof due to temperature change.

Figure 5:
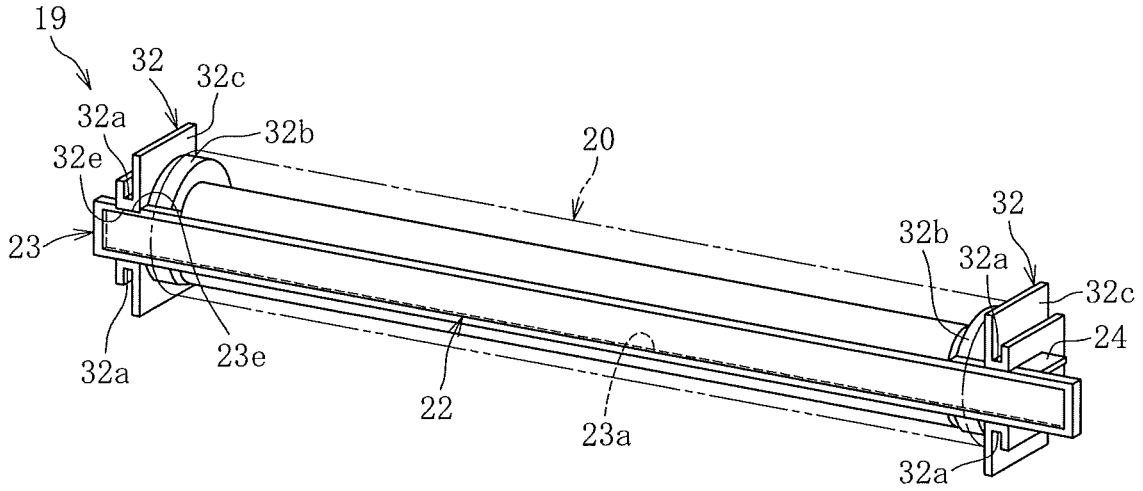
FIG. 5 is a perspective view of a heating device incorporated in the fixing device depicted in FIG. 2.
Figure 6:
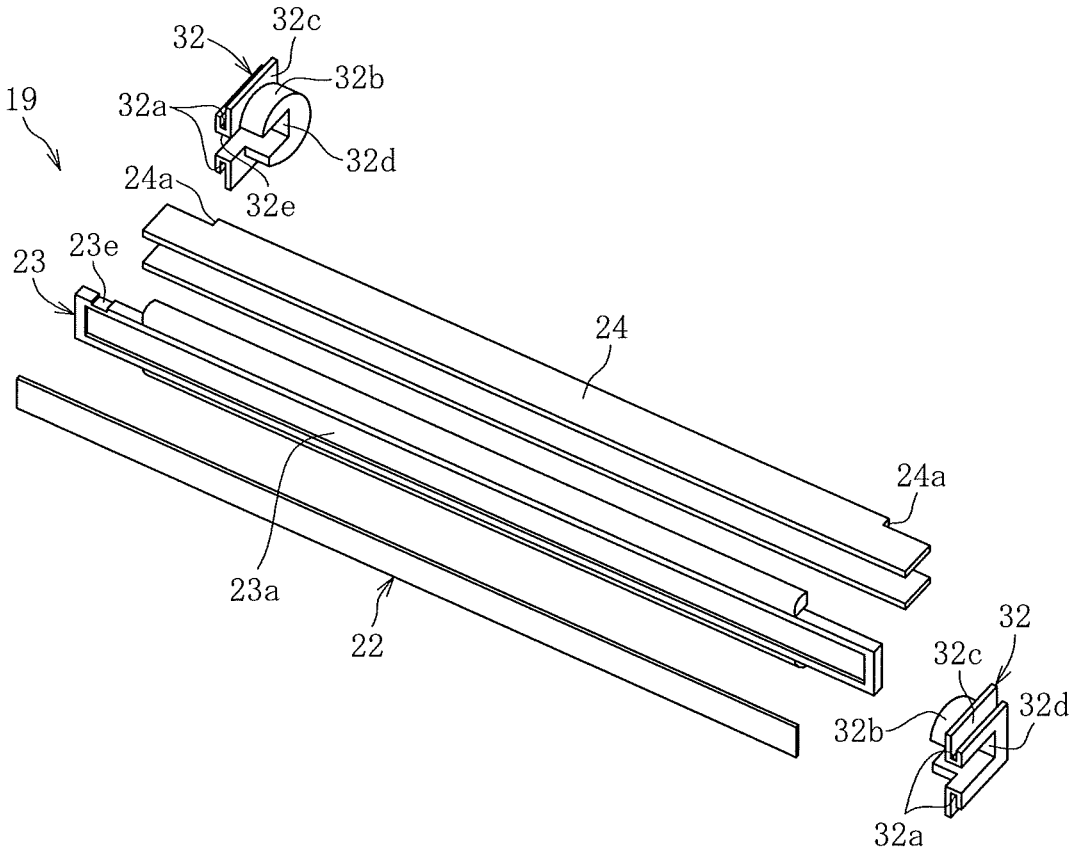
FIG. 6 is an exploded perspective view of the heating device depicted in FIG. 5.

FIG. 5 is a perspective view of the heating device 19. FIG. 6 is an exploded perspective view of the heating device 19.

As illustrated in FIGS. 5 and 6, the heater holder 23 includes an accommodating recess 23*a* disposed on a belt side face of the heater holder 23, that faces the fixing belt 20 and the fixing nip N. The accommodating recess 23*a* is rectangular and accommodates the heater 22. A connector described below sandwiches the heater 22 and the heater holder 23 in a state in which the accommodating recess 23*a* accommodates the heater 22, thus holding the heater 22.

Each of the pair of supports 32 includes a belt support 32*b*, a belt restrictor 32*c*, and a supporting recess 32*d*. The belt support 32*b* is C-shaped and inserted into the loop formed by the fixing belt 20, thus contacting the inner circumferential surface of the fixing belt 20 to support the fixing belt 20. The belt restrictor 32*c* is a flange that contacts an edge face of the fixing belt 20 to restrict motion (e.g., skew) of the fixing belt 20 in the width direction of the fixing belt 20. The supporting recess 32*d* is inserted with a lateral end of each of the heater holder 23 and the stay 24 in the longitudinal direction thereof, thus supporting the heater holder 23 and the stay 24.

As illustrated in FIGS. 5 and 6, the heater holder 23 includes a positioning recess 23*e*, serving as a positioner, disposed at one lateral end of the heater holder 23 in the longitudinal direction thereof. The support 32 includes an engagement 32*e* illustrated in a left part in FIGS. 5 and 6. The engagement 32*e* engages the positioning recess 23*e*, positioning the heater holder 23 with respect to the support 32 in the longitudinal direction of the heater holder 23. The support 32 illustrated in a right part in FIGS. 5 and 6 does not include the engagement 32*e* and therefore the heater holder 23 is not positioned with respect to the support 32 in the longitudinal direction of the heater holder 23. Thus, the support 32 does not restrict thermal expansion and shrinkage of the heater holder 23 in the longitudinal direction thereof due to temperature change.

As illustrated in FIG. 4, as the guide grooves 32*a* of the support 32 move along the insertion recess 28*b* of the side wall 28, the support 32 is attached to the side wall 28 disposed at each lateral end of the device frame 40 in a longitudinal direction thereof. The support 32, situated at a rear position in FIG. 4, of the two supports 32 illustrated in FIG. 4 positions the heater holder 23 in the longitudinal direction thereof. As the support 32 situated at the rear position in FIG. 4 is attached to the side wall 28, the heater holder 23 is positioned with respect to the side wall 28 in the longitudinal direction of the heater holder 23. Thus, the side wall 28 and the support 32 serve as positioners that position the heater holder 23 with respect to the body of the fixing device 9 in the longitudinal direction of the heater holder 23.

The stay 24 is not positioned with respect to the support 32 in the longitudinal direction of the stay 24. As illustrated in FIG. 6, the stay 24 includes steps 24*a* disposed at both lateral ends of the stay 24 in the longitudinal direction thereof, respectively. The steps 24*a* restrict motion (e.g., dropping) of the stay 24 with respect to the supports 32, respectively, in the longitudinal direction of the stay 24. A gap is provided between the step 24*a* and at least one of the supports 32 in the longitudinal direction of the stay 24. For example, the stay 24 is attached to the supports 32 such that looseness is provided between the stay 24 and each of the supports 32 in the longitudinal direction of the stay 24 so that the supports 32 do not restrict thermal expansion and shrinkage of the stay 24 in the longitudinal direction thereof due to temperature change. That is, the stay 24 is not positioned with respect to one of the supports 32.

Figure 7:
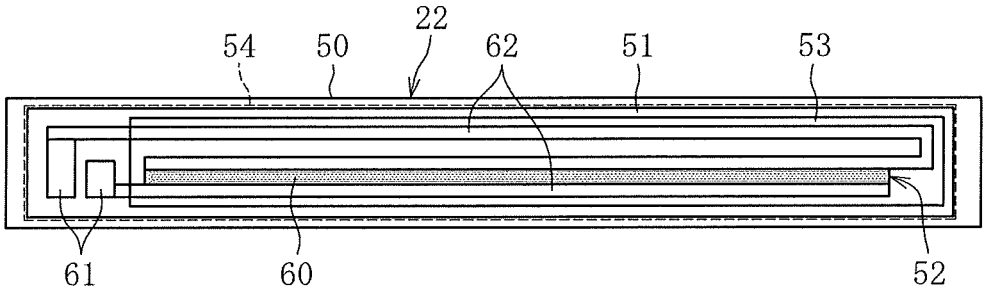
FIG. 7 is a plan view of a heater incorporated in the heating device depicted in FIG. 6.
Figure 8:
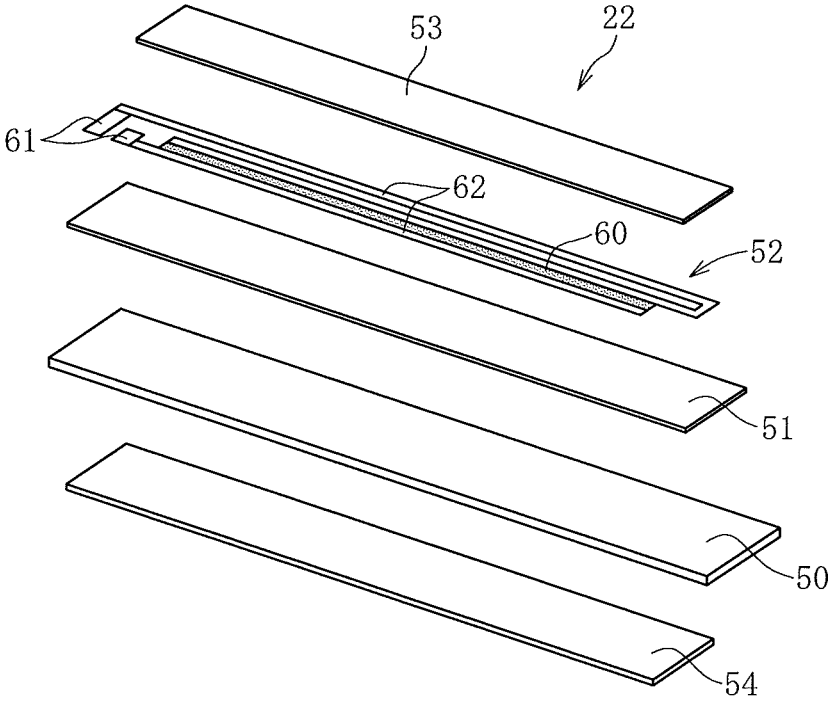
FIG. 8 is an exploded perspective view of the heater depicted in FIG. 7.

FIG. 7 is a plan view of the heater 22. FIG. 8 is an exploded perspective view of the heater 22.

Hereinafter, a front side of the heater 22 defines a side that faces the fixing belt 20 and the fixing nip N. A back side of the heater 22 defines a side that faces the heater holder 23.

As illustrated in FIGS. 7 and 8, the heater 22 is constructed of a plurality of layers, that is, the base layer 50, the first insulating layer 51, the conductor layer 52, the second insulating layer 53, and the third insulating layer 54, which are laminated. The base layer 50 is platy. The first insulating layer 51 is mounted on the front side of the base layer 50. The conductor layer 52 is mounted on the front side of the first insulating layer 51. The second insulating layer 53 coats the front side of the conductor layer 52. The third insulating layer 54 is mounted on the back side of the base layer 50. The conductor layer 52 includes the heat generator 60, a pair of electrodes 61, and two feeders 62. The heat generator 60 includes a laminated, resistive heat generator. The electrodes 61 are disposed outboard from one lateral end of the heat generator 60 in a longitudinal direction thereof. The two feeders 62 sandwich the heat generator 60 in a short direction of the heat generator 60 and couple the electrodes 61 to the heat generator 60. As illustrated in FIG. 7, at least a part of each of the electrodes 61 is not coated with the second insulating layer 53 and is exposed so that the electrodes 61 are connected to the connector described below.

For example, the heat generator 60 is produced as below. Silver-palladium (AgPd), glass powder, and the like are mixed into paste. The paste coats the base layer 50 by screen printing or the like. Thereafter, the base layer 50 is subject to firing. Alternatively, the heat generator 60 may be made of a resistive material such as a silver alloy (AgPt) and ruthenium oxide ($RuO_2$). According to this embodiment, the heat generator 60 extends in a longitudinal direction of the base layer 50. The feeders 62 face both sides of the heat generator 60, respectively, in the short direction thereof. The electrodes 61 are electrically connected to the heat generator 60 through the feeders 62, respectively. The feeders 62 are made of a conductor having a resistance value smaller than a resistance value of the heat generator 60. The feeders 62 and the electrodes 61 are made of a material prepared with silver (Ag), silver-palladium (AgPd), or the like by screen printing or the like.

The base layer 50 is made of metal such as stainless steel (e.g., SUS stainless steel), iron, and aluminum. Instead of metal, the base layer 50 may be made of ceramic, glass, or the like. If the base layer 50 is made of an insulating material such as ceramic, the first insulating layer 51 sandwiched between the base layer 50 and the conductor layer 52 may be omitted. Since metal has an enhanced durability against rapid heating and is processed readily, metal is preferably used to reduce manufacturing costs. Among metals, aluminum and copper are preferable because aluminum and copper attain an increased thermal conductivity and barely suffer from uneven temperature. Stainless steel is advantageous because stainless steel is manufactured at reduced costs compared to aluminum and copper.

Each of the first insulating layer 51, the second insulating layer 53, and the third insulating layer 54 is made of heat resistant glass. Alternatively, each of the first insulating layer 51, the second insulating layer 53, and the third insulating layer 54 may be made of ceramic, PI, or the like.

Figure 9:
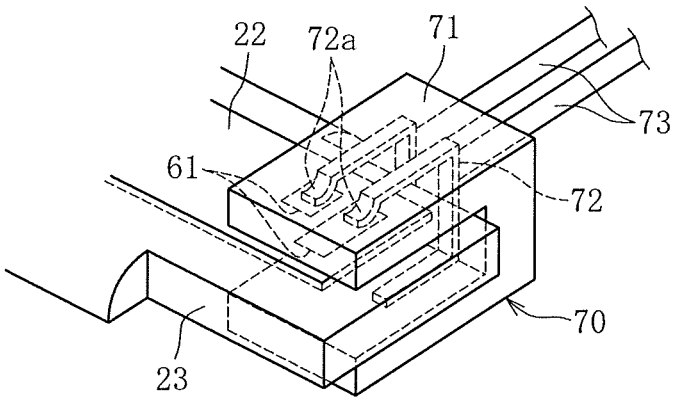
FIG. 9 is a perspective view of the heater and a heater holder incorporated in the heating device depicted in FIG. 6, illustrating a connector attached to the heater and the heater holder.

FIG. 9 is a perspective view of the heater 22 and the heater holder 23, illustrating a connector 70 attached thereto. The connector 70 serves as a feeding member.

As illustrated in FIG. 9, the connector 70 includes a housing 71 made of resin and a contact terminal 72 anchored to the housing 71. The contact terminal 72 is a flat spring. The contact terminal 72 includes a pair of contacts 72*a* that contacts the electrodes 61 of the heater 22, respectively. The contact terminal 72 of the connector 70 is coupled to a harness 73 that supplies power.

As illustrated in FIG. 9, the connector 70 is attached to the heater 22 and the heater holder 23 such that the connector 70 sandwiches the heater 22 and the heater holder 23 together at the front side and the back side, respectively. Accordingly, each of the contacts 72*a* of the contact terminal 72 resiliently contacts or presses against the electrode 61 of the heater 22. Consequently, the heat generator 60 is electrically connected to a power supply disposed in the image forming apparatus 100 through the connector 70, allowing the power supply to supply power to the heat generator 60.

In order to retain proper conductivity between the contacts 72*a* of the connector 70 and the electrodes 61, respectively, for an extended period of time, contact pressure with which the connector 70 contacts the electrodes 61 is requested to be retained appropriately. However, the connector 70 may suffer from temperature increase (e.g., overheating) by hot air generated by the heater 22, heat conducted from the heater 22 through contact portions (e.g., the electrodes 61) where the connector 70 contacts the heater 22, and the like. Accordingly, if the connector 70 does not have a sufficient creep resistance, the connector 70 may suffer from creep deformation as the temperature of the connector 70 increases, thus contacting the electrodes 61 with decreased pressure. Hence, in order to retain conduction between the connector 70 and the electrodes 61 appropriately for an extended period of time, a mechanism to suppress temperature increase of the connector 70 is requested.

Although temperature increase of the connector 70 is caused mainly by heat generated by the heater 22, heat generation of the connector 70 while the connector 70 is energized is also one of causes of temperature increase of the connector 70. Hence, if heat generation of the connector 70 in accordance with energization of the connector 70 decreases, temperature increase of the connector 70 may be suppressed.

To address this circumstance, the connector 70 according to this embodiment is made of a corson copper alloy. The corson copper alloy contains copper (Cu) as a main ingredient and is a copper alloy (e.g., a Cu—Ni—Si alloy) containing at least nickel (Ni) and silicon (Si). Alternatively, in addition to copper, nickel, and silicon, the corson copper alloy may contain at least any one of tin (Su), zinc (Zn), magnesium (Mg), and manganese (Mn).

A conductivity of the corson copper alloy is greater than a conductivity of beryllium copper generally used for connectors. That is, a resistance value of the corson copper alloy is smaller than a resistance value of beryllium copper, attaining suppressed heat generation while the connector 70 is energized. Accordingly, the connector 70 made of the corson copper alloy decreases heat generation of the connector 70 while the connector 70 is energized, suppressing temperature increase of the connector 70.

If the contact portions (e.g., the electrodes 61) of the heater 22, that contact the connector 70, are made of silver or a silver alloy, contact portions (e.g., the contacts 72*a* of the contact terminal 72) of the connector 70, that contact the heater 22, are preferably coated with silver or the silver alloy. Accordingly, galvanic corrosion caused by contact between different metal materials is suppressed. If the heat generator 60 is produced by printing and firing paste prepared with a silver-palladium alloy, the contact portions of the connector 70 and the heater 22 are made of silver or the silver alloy without gold plating or the like, reducing manufacturing costs.

Figure 10:
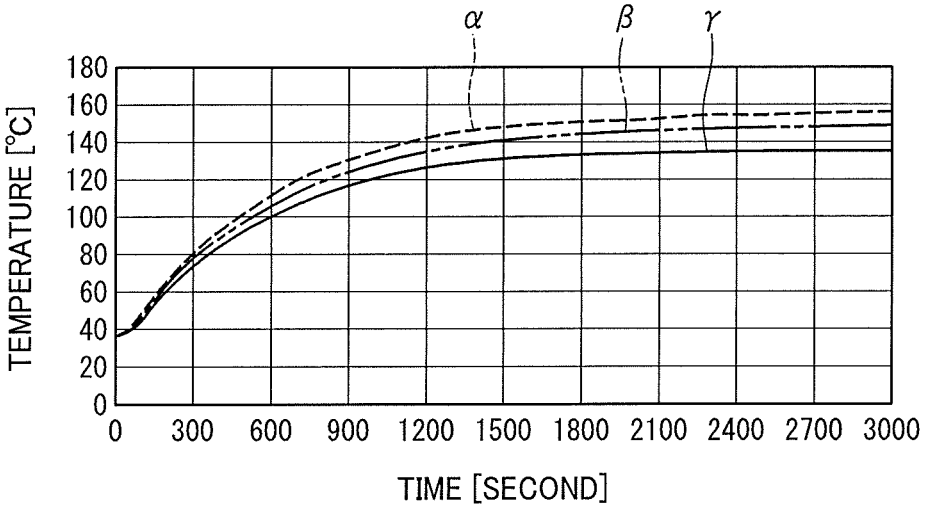
FIG. 10 is a graph illustrating comparison in temperature change between a connector according to an embodiment of the present disclosure and a connector according to a comparative example.

FIG. 10 illustrates comparison in temperature change between a corson copper connector made of the corson copper alloy and a beryllium copper connector made of beryllium copper.

FIG. 10 illustrates temperature changes of the corson copper connector and the beryllium copper connector, which were measured under an identical condition except that the corson copper connector and the beryllium copper connector were made of different materials, that is, the corson copper alloy and beryllium copper, respectively. A dotted line α represents a temperature change of the beryllium copper connector. An alternate long and two short dashes line β represents a temperature change of the corson copper connector.

The temperature changes in FIG. 10 illustrate results of a test conducted as below. For example, each of the beryllium copper connector and the corson copper connector was placed similarly at a position in proximity to a driving force transmission gear coupled to a pressure roller disposed in fixing devices having an identical construction. 2,500 sheets of A4 size in portrait orientation, that had a ream weight of 90 kg as a weight of 1,000 sheets of paper, such as cards and postcards, were printed at a print speed of 50 sheets per minute (50 ppm) as a single set. When printing was performed for 10 sets, the temperature of each of the beryllium copper connector and the corson copper connector, that is presented by a vertical axis, was measured as time elapsed as presented by a horizontal axis.

As illustrated in FIG. 10 with the dotted line α, the temperature of the beryllium copper connector increased to 160 degrees Celsius. Conversely, as illustrated with the alternate long and two short dashes line β, the temperature of the corson copper connector increased to 150 degrees Celsius. It is assumed that the corson copper connector attained suppressed heat generation while the corson copper connector was energized compared to the beryllium copper connector because a conductivity of the corson copper connector was greater than a conductivity of the beryllium copper connector.

As the results of the test indicate, the corson copper connector made of the corson copper alloy decreased heat generation thereof while the corson copper connector was energized, compared to the beryllium copper connector made of beryllium copper, thus suppressing temperature increase of the corson copper connector and thereby suppressing decrease in contact pressure of the corson copper connector due to creep deformation.

In the fixing device 9 according to this embodiment, the driving force transmission gear 31 is disposed at one lateral end of the pressure roller 21 in the axial direction thereof. In a driving side of the fixing device 9 where the driving force transmission gear 31 is situated, the driving force transmission gear 31 meshes with the gear disposed inside the body 103 of the image forming apparatus 100, generating heat. Accordingly, an ambient temperature in the driving side is subject to a temperature higher than an ambient temperature of a non-driving side opposite the driving side in the longitudinal direction of the fixing device 9.

Additionally, in a model of the fixing device 9, that is adapted to high speed printing, in order to increase a length of the fixing nip N in a sheet conveyance direction, the elastic layer 21*b*, serving as a viscoelastic layer, of the pressure roller 21 is requested to be compressed substantially at the fixing nip N. As the elastic layer 21*b* is compressed, the elastic layer 21*b* is deformed viscoelastically, increasing torque that increases an amount of heat generated at the driving force transmission gear 31.

Additionally, while the fixing belt 20 slides over the heater 22, a frictional resistance generates, increasing torque that increases the amount of heat generated at the driving force transmission gear 31. Hence, in order to suppress temperature increase of the connector 70, the connector 70 is not preferably disposed in proximity to the driving force transmission gear 31 that generates heat.

Figure 11:
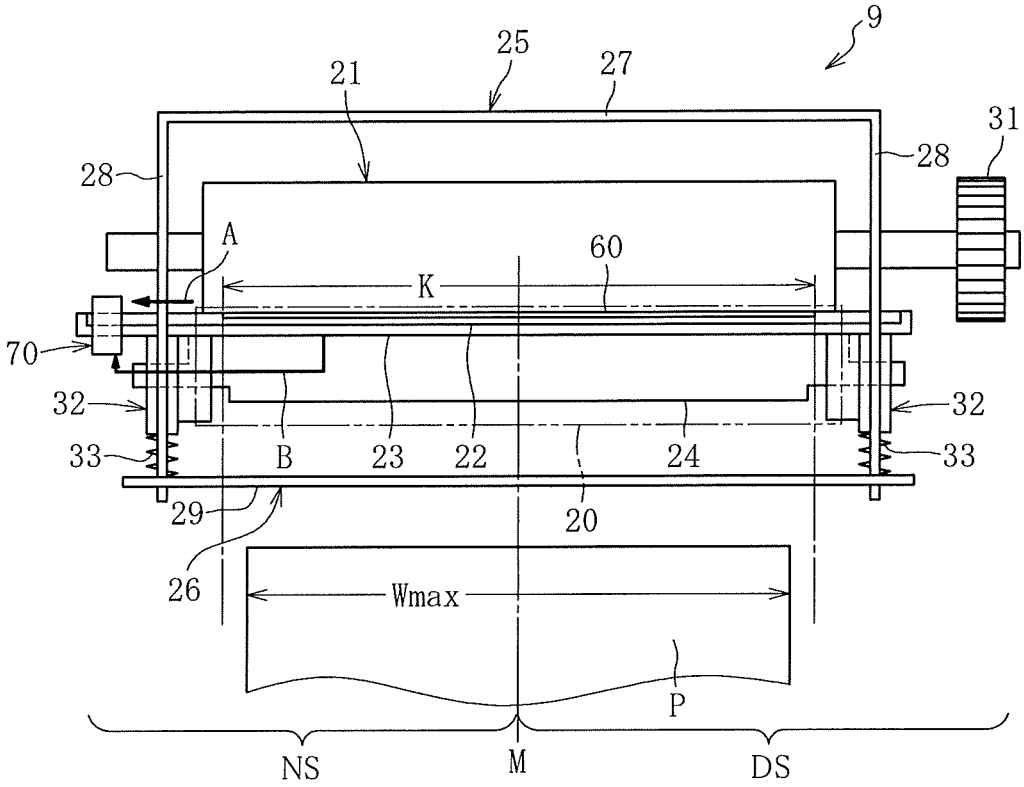
FIG. 11 is a plan view of the fixing device depicted in FIG. 2, illustrating one example of a layout of the fixing device.

To address this circumstance, in the fixing device 9 according to this embodiment, as illustrated in FIG. 11, the connector 70 is disposed in a non-driving side NS (e.g., a left side in FIG. 11) defined by a center M of the heat generator 60 in the longitudinal direction of the heater 22. The non-driving side NS is opposite a driving side DS in the longitudinal direction of the heater 22, where the driving force transmission gear 31 is disposed. Accordingly, the connector 70 is less susceptible to heat generated by the driving force transmission gear 31, suppressing temperature increase of the connector 70 further.

A solid line γ in FIG. 10 represents a temperature change of a corson copper connector made of the corson copper alloy and disposed in a non-driving side where the driving force transmission gear mounted on the pressure roller is not disposed as an example. The temperature change indicated with the solid line γ was measured under a condition equivalent to the condition described above except that the corson copper connector having the temperature change indicated with the solid line γ was disposed in the non-driving side where the driving force transmission gear was not disposed.

As illustrated in FIG. 10, the temperature of the corson copper connector, that had the temperature change indicated with the solid line γ and was disposed in the non-driving side where the driving force transmission gear was not disposed, increased to 135 degrees Celsius. Conversely, the temperature of the corson copper connector, that had the temperature change indicated with the alternate long and two short dashes line β and was disposed in the driving side where the driving force transmission gear was disposed, increased to 150 degrees Celsius although the corson copper connector indicated with the alternate long and two short dashes line β was made of the corson copper alloy like the corson copper connector indicated with the solid line γ. Accordingly, the corson copper connector situated farther from the driving force transmission gear suppressed temperature increase compared the corson copper connector situated in proximity to the driving force transmission gear.

As described above, the connector 70 is made of the corson copper alloy and disposed in the non-driving side NS that is defined by the center M of the heat generator 60 in the longitudinal direction thereof and is opposite the driving side DS in the longitudinal direction of the heat generator 60, where the driving force transmission gear 31 is disposed. Accordingly, the connector 70 suppresses heat generation thereof while the connector 70 is supplied with power and heat conduction from the driving force transmission gear 31 while the driving force transmission gear 31 generates heat. Consequently, the connector 70 suppresses creep deformation due to temperature increase effectively, retaining proper contact pressure with which the connector 70 contacts the electrodes 61 for an extended period of time. As a result, the connector 70 attains stable conduction to the electrodes 61, enhancing reliability.

For example, in a fixing device adapted to high speed printing, a heater is supplied with power of 1,000 W (e.g., at 100 V under 10 A) or more, or power of 1,300 W or more when the heater is supplied with power in a greater amount. Accordingly, a connector generates heat in a substantial amount as the connector is supplied with power. Thus, in the fixing device adapted to high speed printing, temperature increase of the connector is more serious. Hence, the connector 70 according to this embodiment is preferably employed to suppress temperature increase of the connector 70. Conversely, in a fixing device adapted to low speed printing, a heater is supplied with power in a smaller amount compared to the heater of the fixing device adapted to high speed printing. Accordingly, a connector generates heat in a smaller amount while the connector is supplied with power. However, if a temperature environment of the connector is tough, for example, if the connector is disposed closer to a heat generator to downsize the fixing device, the connector 70 according to this embodiment is employed to suppress temperature increase thereof.

Additionally, if a length K depicted in FIG. 11 of the heat generator 60 of the heater 22 is greater than a maximum sheet width Wmax, the heat generator 60 of the heater 22 preferably has a positive temperature coefficient (PTC) property, that is, a positive temperature coefficient of resistance, and an electric current flows in a short direction of the heater 22. The length K defines a conveyance span where a sheet P, serving as a recording medium, of a maximum size available in the fixing device 9 is conveyed.

For example, if the length K of the heat generator 60 is greater than the maximum sheet width Wmax in the longitudinal direction of the heater 22, the temperature of the heat generator 60 may increase substantially in a non-conveyance span where the sheet P is not conveyed, causing the connector 70 disposed opposite one lateral end of the heater 22 in the longitudinal direction thereof to be subject to temperature increase by heat generated in the non-conveyance span. However, since the heat generator 60 has the PTC property and the electric current flows in the short direction of the heater 22, as the temperature of the heat generator 60 increases in the non-conveyance span, the resistance value increases, preferably suppressing temperature increase in the non-conveyance span of the heat generator 60 and in a periphery of the connector 70.

Figure 12:
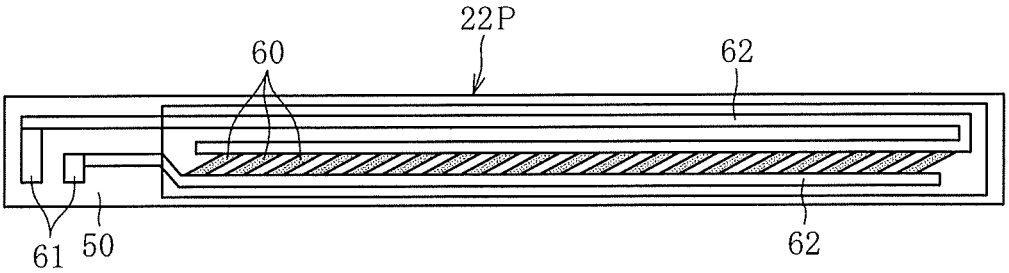
FIG. 12 is a plan view of a heater installable in the heating device depicted in FIG. 6, that incorporates heat generators connected in parallel.

As illustrated in FIG. 7, the heater 22 includes the single heat generator 60 that extends continuously in the longitudinal direction of the heater 22. Alternatively, as illustrated in FIG. 12, a heater 22P that includes a plurality of heat generators 60 may be employed. The heat generators 60 are connected in parallel and each of the heat generators 60 is short and linear. The resistance value of the heat generators 60 is adjusted to be a desired value. If the plurality of heat generators 60 is connected in parallel as illustrated in FIG. 12, the heat generators 60 are inclined such that adjacent ones of the heat generators 60 partially overlap each other in a longitudinal direction of the heater 22P, thus suppressing temperature decrease at an interval between the adjacent ones of the heat generators 60.

In order to suppress temperature increase of the connector 70 as the temperature of the heat generators 60 in the non-conveyance span increases, the heat generators 60 having a negative temperature coefficient (NTC) property, that is, a negative temperature coefficient of resistance, are preferably employed instead of the heat generators 60 having the PTC property. The heat generators 60 having the NTC property are connected such that the electric current flows in the longitudinal direction of the heater 22P through at least a part of the heat generators 60. Accordingly, as the temperature of the heat generators 60 in the non-conveyance span increases, the resistance value decreases, suppressing temperature increase of the heat generators 60 in the non-conveyance span.

Figure 13:
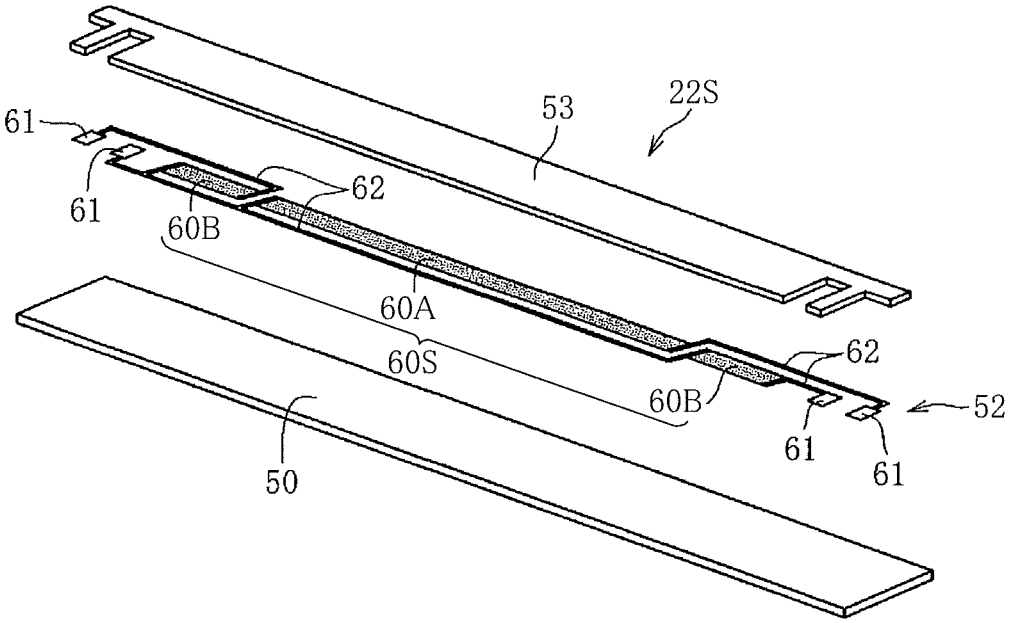
FIG. 13 is a perspective view of a heater installable in the heating device depicted in FIG. 6, that incorporates a plurality of heat generating portions.

Alternatively, as illustrated in FIG. 13, a heater 22S incorporating a heat generator 60S that includes a plurality of heat generating portions 60A and 60B may be employed. The heat generating portions 60A and 60B are arranged in the axial direction of the fixing belt 20 such that the heat generating portions 60A and 60B are controlled separately to generate heat. In this case, since the heat generating portions 60A and 60B are controlled separately to achieve heat generation amounts, respectively, the temperature of the heat generator 60S in the non-conveyance span does not increase excessively, thus suppressing temperature increase of the connector 70, that is caused by temperature increase of the heat generator 60S in the non-conveyance span.

In order to suppress temperature increase of the connector 70 further, the stay 24 is preferably not elongated excessively. Heat is conducted from the heater 22 to the connector 70 directly through a path indicated with an arrow A in FIG. 11. Additionally, heat is conducted from the heater 22 to the stay 24 through the heater holder 23, increasing an ambient temperature of a periphery of the stay 24. Heat is conducted from the periphery of the stay 24 to the connector 70 through a path indicated with an arrow B in FIG. 11. Accordingly, if the stay 24 extends to a position where the stay 24 is disposed opposite the connector 70 or a position where the stay 24 is in proximity to the connector 70, the connector 70 is susceptible to heat conducted through the stay 24. For example, if the stay 24 is made of a material having a thermal conductivity greater than a thermal conductivity of the heater holder 23, the connector 70 is more susceptible to heat conducted through the stay 24.

Hence, in order to suppress temperature increase of the connector 70, as illustrated in FIG. 11, in order to prevent the stay 24 from being disposed in proximity to the connector 70 excessively, one lateral end (e.g., a left end in FIG. 11) of the stay 24 in the longitudinal direction thereof is preferably disposed inboard from the connector 70 in the longitudinal direction of the heater 22.

Figure 14:
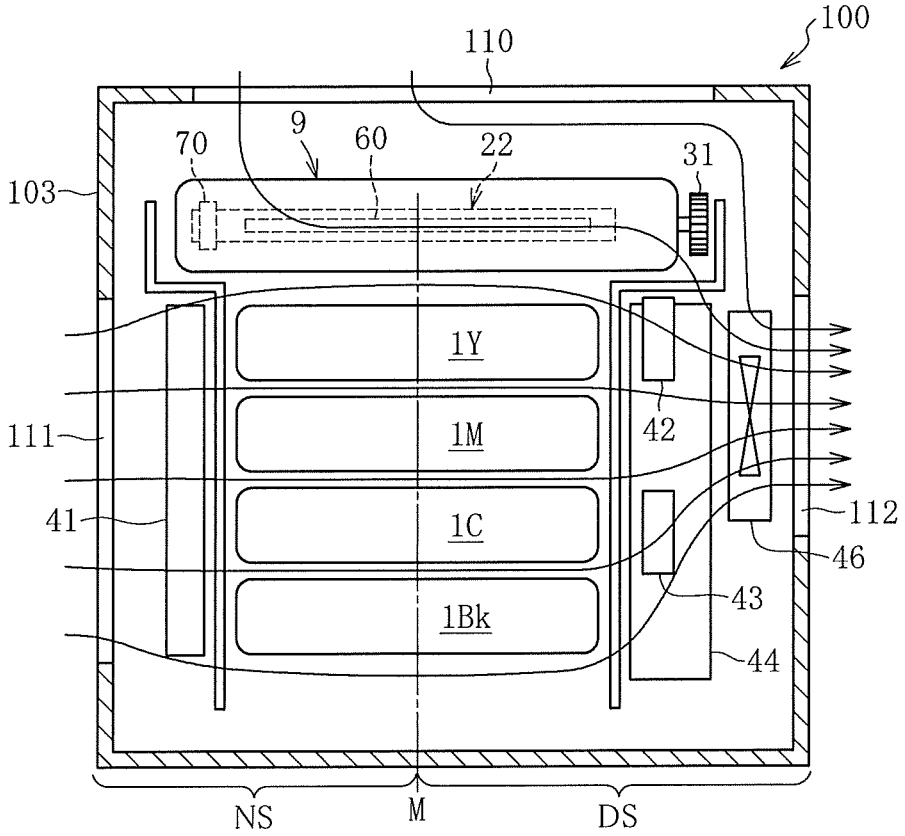
FIG. 14 is a plan view of the image forming apparatus depicted in FIG. 1, illustrating one example of a layout inside a body of the image forming apparatus.

FIG. 14 is a plan view of the image forming apparatus 100, illustrating one example of a layout inside the body 103 of the image forming apparatus 100.

According to the example of the image forming apparatus 100 illustrated in FIG. 14, a high voltage board 41 that supplies power to the chargers 3 and the like of the image forming units 1Y, 1M, 1C, and 1Bk, respectively, is disposed on the left of the image forming units 1Y, 1M, 1C, and 1Bk in FIG. 14. Conversely, a fixing motor 42, an image forming motor 43, and a power supply 44 are disposed on the right of the image forming units 1Y, 1M, 1C, and 1Bk in FIG. 14. The fixing motor 42 serves as a fixing driver that drives the elements of the fixing device 9 such as the pressure roller 21. The image forming motor 43 serves as an image forming driver that drives the photoconductor 2, the developing device 4, and the like of each of the image forming units 1Y, 1M, 1C, and 1Bk. The power supply 44 is a power supply unit (PSU) that supplies power to the fixing motor 42, the image forming motor 43, the heater 22 of the fixing device 9, and the like.

The fixing motor 42, the image forming motor 43, and the power supply 44 that are disposed on the right of the image forming units 1Y, 1M, 1C, and 1Bk generate heat as the fixing motor 42, the image forming motor 43, and the power supply 44 are driven or supplied with power. Accordingly, in order to prevent heat generated by the fixing motor 42, the image forming motor 43, and the power supply 44 from increasing the temperature of the connector 70, the connector 70 is preferably disposed in the non-driving side NS that is defined by the center M of the heat generator 60 in the longitudinal direction thereof and is opposite the driving side DS in the longitudinal direction of the heat generator 60, where the fixing motor 42, the image forming motor 43, and the power supply 44 are disposed, like the example of the image forming apparatus 100 depicted in FIG. 14.

According to the example of the image forming apparatus 100 illustrated in FIG. 14, a fan 46 serving as an exhaust fan is disposed inside the body 103 of the image forming apparatus 100. An inlet 110 is disposed in a front cover (e.g., an upper cover in FIG. 14) of the body 103 of the image forming apparatus 100. An inlet 111 is disposed in one of both side covers (e.g., a left side cover in FIG. 14) of the body 103 of the image forming apparatus 100. An outlet 112 is disposed in another one of both side covers (e.g., a right side cover in FIG. 14) of the body 103 of the image forming apparatus 100. As the fan 46 is driven by power supplied from the power supply 44, air flow indicated with arrows in FIG. 14 generates inside the body 103 of the image forming apparatus 100. Air enters from the outside of the image forming apparatus 100 into the body 103 of the image forming apparatus 100 through each of the inlets 110 and 111. Air is exhausted from the body 103 of the image forming apparatus 100 through the outlet 112. While air passes inside the body 103 of the image forming apparatus 100, air draws heat from the fixing device 9, the fixing motor 42, the image forming motor 43, the power supply 44, and the like and is exhausted. Thus, air cools the fixing device 9, the fixing motor 42, the image forming motor 43, the power supply 44, and the like, suppressing temperature increase thereof.

Since air passing inside the body 103 of the image forming apparatus 100 absorbs heat inside the body 103, a temperature at a position in proximity to the outlet 112 is higher than temperatures at positions in proximity to the inlets 110 and 111, respectively. Hence, if the connector 70 is situated at the position in proximity to the outlet 112, air heated to a high temperature heats the connector 70. For example, if the image forming apparatus 100 is a model adapted to high speed printing, the image forming apparatus 100 generates an increased amount of heat inside the body 103 thereof, causing serious temperature increase in the periphery of the connector 70. A cover of the fixing device 9 has a gear slot disposed opposite the driving force transmission gear 31 mounted on the pressure roller 21. The driving force transmission gear 31 is coupled to the gear disposed inside the body 103 of the image forming apparatus 100 through the gear slot. The fixing device 9 also has a sheet slot through which a sheet P is conveyed into the fixing device 9. As hot air moves from the sheet slot to the gear slot, the temperature inside the fixing device 9 increases. To address this circumstance, the fan 46 may increase air flow, for example, to decrease the temperature inside the fixing device 9. However, noise and the size of the image forming apparatus 100 may increase disadvantageously.

In view of those circumstances and temperature increase of the connector 70, the connector 70 is not preferably disposed in proximity to the outlet 112. Accordingly, like the example of the image forming apparatus 100 illustrated in FIG. 14, the connector 70 is preferably disposed in the non-driving side NS that is defined by the center M of the heat generator 60 in the longitudinal direction thereof and is opposite the driving side DS in the longitudinal direction of the heat generator 60, where the outlet 112 and the fan 46 disposed in proximity to the outlet 112 are situated.

Additionally, according to the example of the image forming apparatus 100 illustrated in FIG. 14, the outlet 112 is disposed in the right side cover in FIG. 14 of the body 103 of the image forming apparatus 100. Accordingly, hot air exhausted from the outlet 112 does not blow against a user of the image forming apparatus 100, who stands in front of the front cover of the body 103, thus enhancing comfort. For example, the outlet 112 is preferably disposed in a face other than a face that is faced by the user who operates the image forming apparatus 100 and is mounted with a controller such as a control panel.

Figure 15:
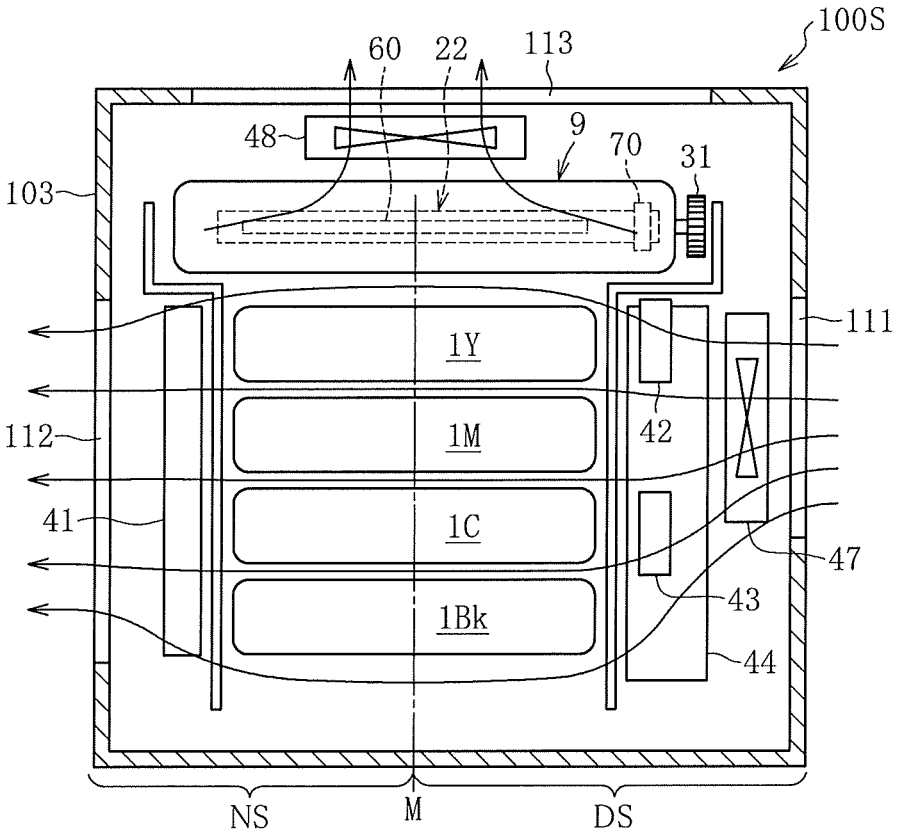
FIG. 15 is a plan view of an image forming apparatus as a variation of the image forming apparatus depicted in FIG. 1, illustrating another example of the layout inside the body.

FIG. 15 is a plan view of an image forming apparatus 100S, illustrating another example of the layout inside the body 103.

According to the example of the image forming apparatus 100S illustrated in FIG. 15, air flow is directed in a leftward direction opposite a rightward direction in which air flow is directed in the image forming apparatus 100 as described above with reference to FIG. 14. For example, according to the example of the image forming apparatus 100S illustrated in FIG. 15, the fan 47 serving as an intake fan intakes air from an outside of the image forming apparatus 100S through the inlet 111 disposed in the right side cover in FIG. 15. Air is exhausted from the body 103 of the image forming apparatus 100S through the outlet 112 disposed in the left side cover in FIG. 15.

The temperature of air passing inside the body 103 of the image forming apparatus 100S is higher in the non-driving side NS, that is, a left side in FIG. 15, than in the driving side DS, that is, a right side in FIG. 15. Accordingly, the connector 70 is preferably disposed in the right side in FIG. 15, that is, the driving side DS that is defined by the center M of the heat generator 60 in the longitudinal direction thereof and is opposite the non-driving side NS in the longitudinal direction of the heat generator 60, where the outlet 112 is disposed. In view of a positional relation of the connector 70 with respect to the inlet 111 and the fan 47 disposed in proximity to the inlet 111, the connector 70 is disposed in the driving side DS defined by the center M of the heat generators 60 in the longitudinal direction thereof, where the inlet 111 and the fan 47 are disposed. Accordingly, cool air that has a low temperature and is intaken through the inlet 111 travels to the connector 70, suppressing temperature increase of the connector 70.

According to the example of the image forming apparatus 100S illustrated in FIG. 15, an outlet 113 is disposed in the front cover (e.g., an upper cover in FIG. 15) of the body 103 of the image forming apparatus 100S. A fan 48 is disposed in proximity to the outlet 113 separately from the fan 47. The fan 48 blows air against a sheet guide 57 illustrated in FIG. 16 disposed above the fixing device 9, the sheet ejection device 10 disposed in a periphery of the sheet guide 57, and the like, thus cooling the sheet guide 57 and the sheet ejection device 10. Additionally, the fan 48 ventilates the sheet guide 57 and the periphery thereof, suppressing condensation. A part of air that flows toward the outlet 113 disposed in the front cover is heated while passing through the fixing device 9. However, since the connector 70 is disposed upstream from air flow that passes through the fixing device 9 in an air flow direction, the connector 70 attains suppressed temperature increase.

Figure 16:
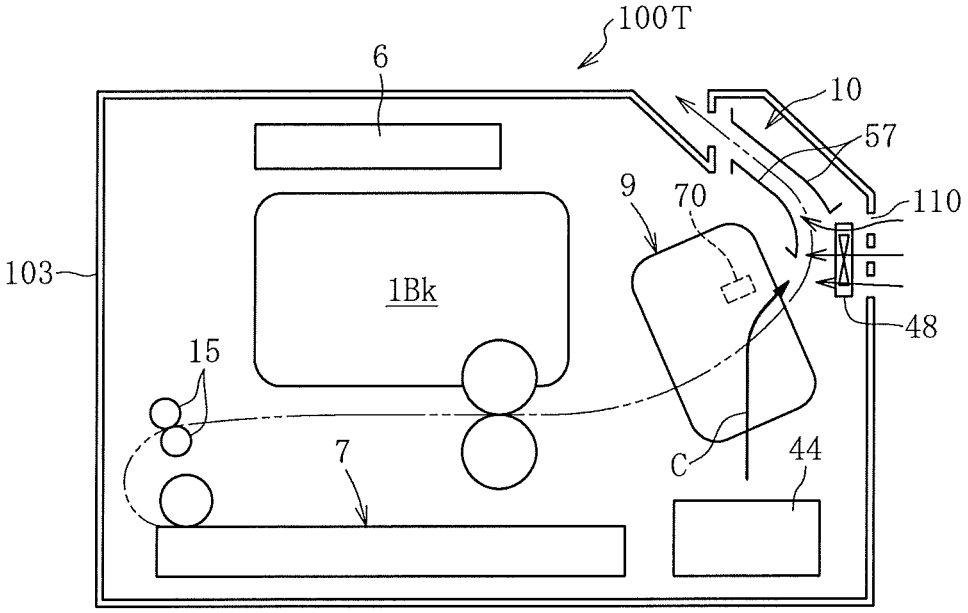
FIG. 16 is a side view of an image forming apparatus as another variation of the image forming apparatus depicted in FIG. 1, illustrating yet another example of the layout inside the body.
Figure 17:
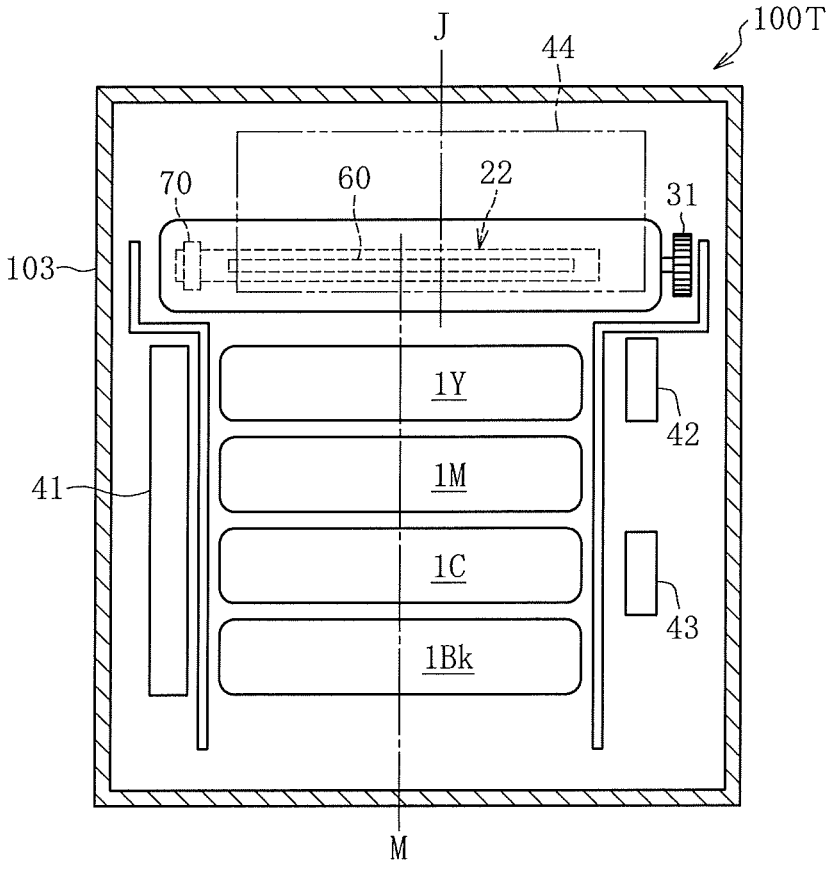
FIG. 17 is a plan view of the image forming apparatus depicted in FIG. 16.

FIG. 16 is a side view of an image forming apparatus 100T, illustrating another example of the layout inside the body 103. FIG. 17 is a plan view of the image forming apparatus 100T.

As the power supply 44 disposed inside the body 103 of the image forming apparatus 100T generates heat, an ambience around the power supply 44, that is heated by the power supply 44, usually moves upward in a direction indicated with an arrow C in FIG. 16. Hence, if the power supply 44 is situated below the fixing device 9, the connector 70 disposed inside the fixing device 9 is susceptible to heat from the power supply 44.

To address this circumstance, if the power supply 44 is disposed below the fixing device 9, in order to prevent the connector 70 from being susceptible to heat from the power supply 44, the power supply 44 is preferably shifted from a position below the connector 70, that is, a position where the power supply 44 overlaps the connector 70 in a gravity direction, as illustrated in FIG. 17. For example, the power supply 44 is shifted from the connector 70 horizontally. In the image forming apparatus 100T, a center J of the power supply 44 in a longitudinal direction thereof is shifted from the center M of the heat generator 60 horizontally in a direction in which the center J of the power supply 44 is disposed opposite the connector 70 via the center M of the heat generator 60. Thus, the power supply 44 is disposed away or distanced from the connector 70.

As described above, the image forming apparatus 100T employs the layout in which the connector 70 is disposed away from various motors (e.g., the fixing motor 42 and the image forming motor 43), the power supply 44, and the like that generate heat, thus suppressing temperature increase of the connector 70 further. Accordingly, conduction from the connector 70 to the electrodes 61 is retained more precisely, enhancing reliability.

Figure 18:
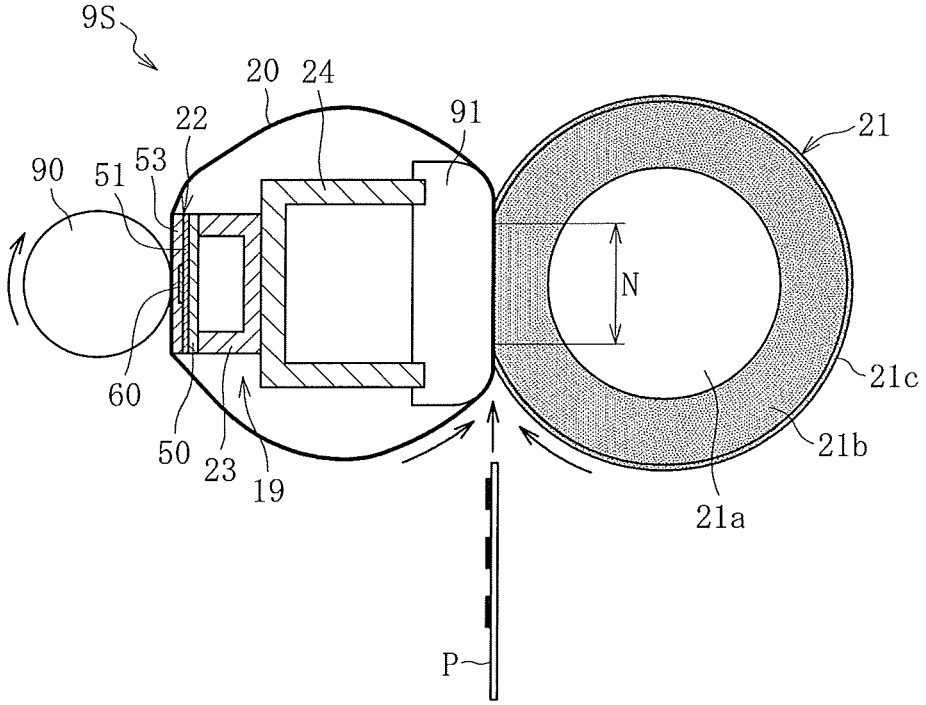
FIG. 18 is a schematic cross-sectional view of a fixing device installable in the image forming apparatus depicted in FIG. 1 as a first variation of the fixing device depicted in FIG. 2.
Figure 19:
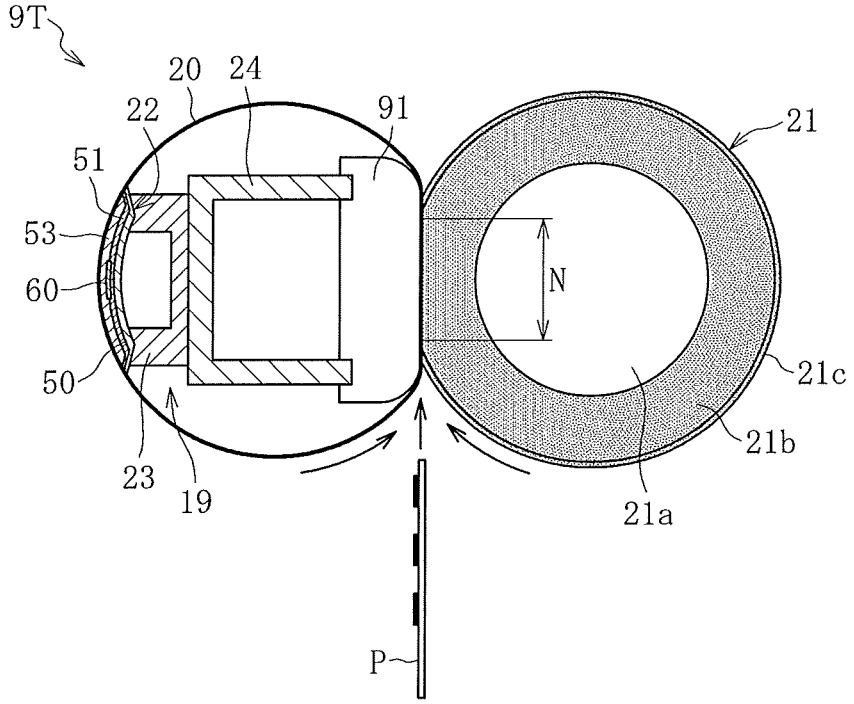
FIG. 19 is a schematic cross-sectional view of a fixing device installable in the image forming apparatus depicted in FIG. 1 as a second variation of the fixing device depicted in FIG. 2.
Figure 20:
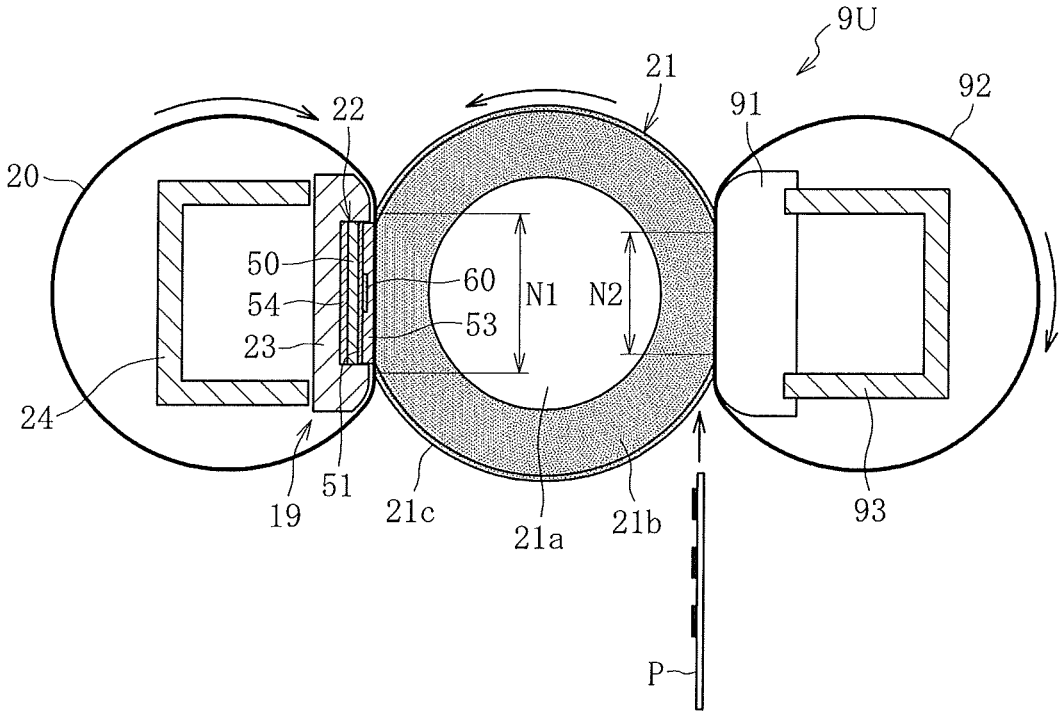
FIG. 20 is a schematic cross-sectional view of a fixing device installable in the image forming apparatus depicted in FIG. 1 as a third variation of the fixing device depicted in FIG. 2.

The embodiments of the present disclosure are applicable to fixing devices 9S, 9T, and 9U illustrated in FIGS. 18 to 20, respectively, other than the fixing device 9 described above. The following briefly describes a construction of each of the fixing devices 9S, 9T, and 9U depicted in FIGS. 18 to 20, respectively.

A description is provided of a construction of the fixing device 9S depicted in FIG. 18.

As illustrated in FIG. 18, the fixing device 9S includes a pressing roller 90 disposed opposite the pressure roller 21 via the fixing belt 20. The pressing roller 90 and the heater 22 sandwich the fixing belt 20 so that the heater 22 heats the fixing belt 20. On the other hand, the nip forming pad 91 is disposed inside the loop formed by the fixing belt 20 and disposed opposite the pressure roller 21. The stay 24 supports the nip forming pad 91. The nip forming pad 91 and the pressure roller 21 sandwich the fixing belt 20 and define the fixing nip N.

A description is provided of a construction of the fixing device 9T depicted in FIG. 19.

As illustrated in FIG. 19, the fixing device 9T does not include the pressing roller 90 described above with reference to FIG. 18. In order to attain a contact length for which the heater 22 contacts the fixing belt 20 in the circumferential direction thereof, the heater 22 is curved into an arc in cross section that corresponds to a curvature of the fixing belt 20. Other construction of the fixing device 9T is equivalent to that of the fixing device 9S depicted in FIG. 18.

A description is provided of a construction of the fixing device 9U depicted in FIG. 20.

As illustrated in FIG. 20, the fixing device 9U includes a pressure belt 92 in addition to the fixing belt 20. The pressure belt 92 and the pressure roller 21 form a fixing nip N2 serving as a secondary nip separately from a heating nip N1 serving as a primary nip formed between the fixing belt 20 and the pressure roller 21. For example, the nip forming pad 91 and a stay 93 are disposed opposite the fixing belt 20 via the pressure roller 21. The pressure belt 92 that is rotatable accommodates the nip forming pad 91 and the stay 93. As a sheet P bearing a toner image is conveyed through the fixing nip N2 formed between the pressure belt 92 and the pressure roller 21, the pressure belt 92 and the pressure roller 21 fix the toner image on the sheet P under heat and pressure. Other construction of the fixing device 9U is equivalent to that of the fixing device 9 depicted in FIG. 2.

The heaters 22, 22P, and 22S according to the embodiments of the present disclosure are also applicable to devices other than the fixing devices 9, 9S, 9T, and 9U. For example, the heaters 22, 22P, and 22S according to the embodiments of the present disclosure are also applicable to a dryer installed in an image forming apparatus employing an inkjet method. The dryer dries ink applied onto a sheet. Alternatively, the heaters 22, 22P, and 22S according to the embodiments of the present disclosure may be applied to a coater (e.g., a laminator) that thermally presses film serving as a coating member onto a surface of a sheet (e.g., paper) serving as a conveyed medium while a belt conveys the sheet. The heating device 99 according to the embodiments of the present disclosure is not limited to a belt heating device that heats a belt and may be a heating device that does not incorporate the belt.

A description is provided of advantages of a heating device (e.g., the heating device 99).

As illustrated in FIGS. 2, 11, 12, and 13, the heating device includes a heater (e.g., the heaters 22, 22P, and 22S), a feeding member (e.g., the connector 70), an endless belt (e.g., the fixing belt 20), a driving roller (e.g., the pressure roller 21), and a driving force transmitter (e.g., the driving force transmission gear 31). The heater is a laminated heater, for example. The heater includes a heat generator (e.g., the heat generators 60 and 60S) that generates heat as the heat generator is supplied with power. The feeding member contacts the heater and feeds the power to the heat generator. The endless belt is heated by the heater and is rotatable. The driving roller contacts an outer circumferential surface of the endless belt. The driving force transmitter is disposed at a lateral end of the driving roller in an axial direction of the driving roller. The driving force transmitter transmits a driving force that drives and rotates the driving roller. The feeding member is made of a corson copper alloy.

As illustrated in FIG. 14, the feeding member is disposed in a non-driving side (e.g., the non-driving side NS) defined by a center (e.g., the center M) of the heat generator in a longitudinal direction of the heater. The non-driving side is opposite a driving side (e.g., the driving side DS) in the longitudinal direction of the heater, where the driving force transmitter is disposed.

According to the embodiments of the present disclosure, the feeding member made of the corson copper alloy is disposed in the non-driving side defined by the center of the heat generator in the longitudinal direction of the heater, where the driving force transmitter is not disposed. Accordingly, the feeding member decreases heat generation thereof while the feeding member is supplied with power and heat conduction from the driving force transmitter while the driving force transmitter generates heat. Consequently, the feeding member suppresses temperature increase thereof.

According to the embodiments described above, the fixing belt 20 serves as an endless belt. Alternatively, a fixing film, a fixing sleeve, or the like may be used as an endless belt. Further, the pressure roller 21 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. An image forming apparatus, comprising:

an image forming device configured to form an image; and a heating device configured to heat the image borne on a recording medium, wherein the heating device includes a heater including a heat generator configured to generate heat as the heat generator is supplied with power;

a feeding member configured to contact the heater and feed the power to the heat generator;

an endless belt configured to rotate, the endless belt configured to be heated by the heater;

a driving roller configured to contact an outer circumferential surface of the endless belt; and a driving force transmitter disposed at one lateral end of the driving roller in an axial direction of the driving roller, the driving force transmitter configured to transmit a driving force that drives and rotates the driving roller, the feeding member is made of a corson copper alloy, the feeding member being disposed in a non-driving side defined by a center of the heat generator in a longitudinal direction of the heater, the non-driving side being opposite a driving side in the longitudinal direction of the heater, the driving side where the driving force transmitter is disposed, and the image forming apparatus further comprises a body;

an outlet disposed in the body; and an exhaust fan configured to exhaust air through the outlet, wherein the outlet and the exhaust fan are disposed in the driving side where the feeding member is not disposed.

2. The image forming apparatus according to claim 1, wherein the driving roller includes:

a cored bar; and a viscoelastic layer disposed on an outer periphery of the cored bar, and wherein the endless belt is pressed against the driving roller.

3. The image forming apparatus according to claim 1, further comprising:

a holder configured to hold the heater;

a reinforcement configured to reinforce the holder; and a biasing member configured to bias the reinforcement, wherein one lateral end of the reinforcement in a longitudinal direction of the reinforcement is disposed inboard from the feeding member in the longitudinal direction of the heater.

4. The image forming apparatus according to claim 1, wherein the heater further includes a first contact portion configured to contact the feeding member, the first contact portion being made of one of silver and a silver alloy, and wherein the feeding member includes a second contact portion configured to contact the heater, the second contact portion being coated with one of silver and a silver alloy.

5. The image forming apparatus according to claim 1, wherein the heater further includes a nip former disposed opposite an inner circumferential surface of the endless belt, and wherein the nip former and the driving roller sandwich the endless belt to form a nip between the endless belt and the driving roller.

6. The image forming apparatus according to claim 1, wherein the endless belt rotates to convey a conveyed medium, and wherein a length of the heat generator is greater than a length of the conveyed medium in the longitudinal direction of the heater.

7. The image forming apparatus according to claim 1, wherein the heat generator has a positive temperature coefficient property, and wherein an electric current flows through at least a part of the heat generator in a short direction of the heater perpendicular to the longitudinal direction of the heater.

8. The image forming apparatus according to claim 1, wherein the heat generator has a negative temperature coefficient property, and wherein an electric current flows through at least a part of the heat generator in the longitudinal direction of the heater.

9. The image forming apparatus according to claim 1, wherein the heat generator includes a plurality of heat generating portions arranged in an axial direction of the endless belt and configured to generate heat separately.

10. The image forming apparatus according to claim 1, wherein the heater includes a laminated heater and the feeding member includes a connector.

11. The image forming apparatus according to claim 1, further comprising an image forming driver configured to drive the image forming device.

12. The image forming apparatus according to claim 11, wherein the image forming driver is disposed in the driving side where the feeding member is not disposed.

13. The image forming apparatus according to claim 11, further comprising a power supply configured to supply power to at least one of the image forming driver and the heater.

14. The image forming apparatus according to claim 13, wherein the power supply is disposed in the driving side where the feeding member is not disposed.

15. The image forming apparatus according to claim 13, wherein the power supply is distanced from the feeding member.

16. The image forming apparatus according to claim 15, wherein a center of the power supply in a longitudinal direction of the power supply is shifted from the center of the heat generator horizontally in a direction in which the center of the power supply is disposed opposite the feeding member via the center of the heat generator.

17. An image forming apparatus comprising:

an image forming device configured to form an image; and a heating device configured to heat the image borne on a recording medium, wherein the heating device includes a heater including a heat generator configured to generate heat as the heat generator is supplied with power;

a feeding member configured to contact the heater and feed the power to the heat generator;

an endless belt configured to rotate, the endless belt configured to be heated by the heater;

a driving roller configured to contact an outer circumferential surface of the endless belt and a driving force transmitter disposed at one lateral end of the driving roller in an axial direction of the driving roller, the driving force transmitter configured to transmit a driving force that drives and rotates the driving roller, the feeding member is made of a corson copper alloy, the feeding member being disposed in a non-driving side defined by a center of the heat generator in a longitudinal direction of the heater, the non-driving side being opposite a driving side in the longitudinal direction of the heater, the driving side where the driving force transmitter is disposed, and the image forming apparatus further comprises a body; and an inlet disposed in the body, wherein the inlet is disposed in the non-driving side where the feeding member is disposed.

18. The image forming apparatus of claim 17, further comprising an image forming driver configured to drive the image forming device.

19. The image forming apparatus of claim 18, wherein the image forming driver is disposed in the driving side where the feeding member is not disposed.

20. The image forming apparatus of claim 18, further comprising a power supply configured to supply power to at least one of the image forming driver and the heater.

* * * * *